US010767338B2

(12) United States Patent
Azzolin et al.

(10) Patent No.: US 10,767,338 B2
(45) Date of Patent: Sep. 8, 2020

(54) HYDRAULIC APPARATUS FOR EXCAVATORS AND CONSTRUCTION EQUIPMENT IN GENERAL

(71) Applicant: MECCANICA BREGANZESE S.P.A. IN BREVE MB S.P.A., Fara Vicentino (VI) (IT)

(72) Inventors: Guido Azzolin, Breganze (IT); Diego Azzolin, Breganze (IT)

(73) Assignee: MECCANICA BREGANZESE S.P.A. IN BREVE MB S.P.A., Fara Vicentino (VI) (IT)

( * ) Notice: Subject to any disclaimer, the term of this patent is extended or adjusted under 35 U.S.C. 154(b) by 0 days.

(21) Appl. No.: 15/541,183

(22) PCT Filed: Jan. 12, 2016

(86) PCT No.: PCT/EP2016/050428

§ 371 (c)(1),
(2) Date: Nov. 14, 2017

(87) PCT Pub. No.: WO2016/113236

PCT Pub. Date: Jul. 21, 2016

(65) Prior Publication Data

US 2018/0142439 A1 May 24, 2018

(30) Foreign Application Priority Data

Jan. 15, 2015 (IT) ..... PD2015A0005

(51) Int. Cl.
*E02F 3/96* (2006.01)
*E02F 3/20* (2006.01)
(Continued)

(52) U.S. Cl.
CPC ..... *E02F 3/205* (2013.01); *E02F 3/246* (2013.01); *E21C 27/24* (2013.01); *F15B 11/22* (2013.01); *F15B 13/022* (2013.01)

(58) Field of Classification Search
CPC ..... E02F 3/205; E02F 3/246; G05D 11/02
See application file for complete search history.

(56) References Cited

U.S. PATENT DOCUMENTS 796,724 A * 8/1905 Hewitt
2,291,578 A * 7/1942 Johnson ..... B64C 25/22 137/118.01

(Continued)

FOREIGN PATENT DOCUMENTS

EP 1975323 10/2008
GB 1157170 7/1969

OTHER PUBLICATIONS

International Search Report for corresponding PCT Application No. PCT/EP2016/050428 dated Mar. 22, 2016.

*Primary Examiner* — Janine M Kreck
(74) *Attorney, Agent, or Firm* — Caesar Rivise, PC

(57) ABSTRACT

A hydraulic apparatus for a construction equipment, such as an excavator, comprising a support structure connected or connectable to a movable arm of the construction equipment and a pair or rotating drums comprising a plurality of teeth, a pair of hydraulic motors, each arranged for the movement of a particular drum, and a rotating flow divider device. The flow divider device comprises at least one inlet for receiving a supply of operative fluid provided by the construction equipment and a pair of outlets which provide the operative fluid, which is suitably divided, to the pair of hydraulic motors.

11 Claims, 5 Drawing Sheets

(51) Int. Cl.

| | |
|---|---|
| ***E02F 3/24*** | (2006.01) |
| ***E21C 27/24*** | (2006.01) |
| *F15B 11/22* | (2006.01) |
| *F15B 13/02* | (2006.01) |

(56) References Cited

U.S. PATENT DOCUMENTS

| | | | | | |
|---|---|---|---|---|---|
| 2,301,098 | A * | 11/1942 | Twyman | F15B 11/22 | 37/902 |
| 3,480,328 | A * | 11/1969 | Carlson | E21C 31/10 | 299/71 |
| 6,626,500 | B1 | 9/2003 | Cribb et al. | | |
| 7,604,301 | B1 * | 10/2009 | Lang | E02D 3/126 | 299/68 |
| 8,128,178 | B2 | 3/2012 | Chagnot et al. | | |
| 2009/0266422 | A1 * | 10/2009 | Flavelle | G05D 11/005 | 137/99 |

* cited by examiner

HYDRAULIC APPARATUS FOR EXCAVATORS AND CONSTRUCTION EQUIPMENT IN GENERAL

CROSS-REFERENCE TO RELATED APPLICATIONS

This application is the U.S. National Phase Application of PCT/EP2016/050428, filed Jan. 12, 2016, which claims priority from IT PD2015A000005, filed Jan. 15, 2015, the contents of which applications are incorporated herein by reference in their entireties for all purposes.

BACKGROUND OF THE INVENTION

The present invention relates to a hydraulic apparatus, such as a rotating crusher, comprising a hydraulic motor actuated via a power circuit linkable to the main hydraulic circuit of an earth-moving equipment, such as an excavator or an earth-moving equipment in general.

Among the accessories attachable to the arms of excavators and similar construction equipments, it is known to use milling apparatuses, typically known as milling heads or rotating crushers, formed by a pair of drums provided with a row of teeth.

Apparatuses of this type have the advantage of having increased versatility and efficiency, and are typically used in the field of facilities for constructing tunnels or, more generally, in the field of construction works for communication routes and in cutting blocks of stone.

An example of this type of apparatus is described in U.S. Pat. No. 6,626,500, which relates to a rotating cutter comprising a shell on which two rotating drums are supported. The drums are mounted on the same shaft, which is set in rotation by a hydraulic motor actuated by means of an oil supply provided by the construction equipment itself. The apparatus can be fixed to the arm of an excavator via a linking connector in such a way that the operator can displace and orient the cutter as desired so as to excavate in the required position.

One of the problems linked to rotating cutters is that rotor blockages often occur, typically because the variety of the material in terms of hardness and resistance to crushing is never homogeneous, just as the surface to be crushed is not homogeneous. This means that the energy needed for dealing with this material differs between the rotors, creating a greater energy requirement from the rotor which is subjected to higher stress. In these cases, it may actually be found that the construction equipment cannot provide a sufficient torque to keep the drums rotating, partly because they are both meshed to the same rotating shaft and because the torque supplied by the construction equipment is thus inevitably divided into two equal parts.

Therefore, in cases where only one of the two drums comes into contact with harder material, there is actually an inefficient torque distribution.

Further, since the two drums are rigidly interconnected by means of the transmission shaft, there is a significant transmission of stresses and vibrations both to the cutting structure and to the arm of the construction equipment, leading to low precision in the positioning of the arm and thus in the cutting operation, and to potential damage to the arm of the supporting equipment.

A further example of crushing apparatus is disclosed in U.S. Pat. No. 7,604,301, relating to grinder blender comprising two cylindrical drums operated by a respective hydraulic motor. A hydraulic fluid supply line receives hydraulic fluid under pressure from the rotary hydraulic manifold, and discharges the hydraulic fluid to a flow divider. The flow divider supplies hydraulic fluid equally to the two motors through respective high pressure lines.

Therefore, the technical problem addressed by the present invention is to provide a hydraulic apparatus which makes it possible to overcome the drawbacks mentioned above in relation to the known prior art.

This problem is solved by the hydraulic apparatus according to the invention.

BRIEF SUMMARY OF THE INVENTION

Preferred features of the invention are defined in the dependent claims.

The present invention has some major advantages. The main advantage is that the apparatus according to the present invention makes it possible to reduce the number of blockages that can occur during excavating operations and to limit the strains transmitted to the arm of the supporting equipment.

Further, the apparatus according to the present invention makes it possible to achieve better and more efficient exploitation of the torque provided via the hydraulic circuit of the construction equipment.

In addition, the apparatus according to the present invention makes it possible to limit the transmission of stresses, in particular lateral stresses, and vibrations to the arm of the construction equipment to which it is linked, considerably improving operating precision.

This is particularly advantageous in earth-moving equipments in which the arms are dimensioned and designed for withstanding frontal stresses and not lateral stresses.

BRIEF DESCRIPTION OF THE DRAWINGS

Further advantages, features and uses of the present invention will be apparent from the following detailed description of some embodiments, provided in an exemplary and non-restrictive manner. Reference is made to the figures of the accompanying drawings, in which.

DETAILED DESCRIPTION OF PREFERRED EMBODIMENTS

Figure 1:
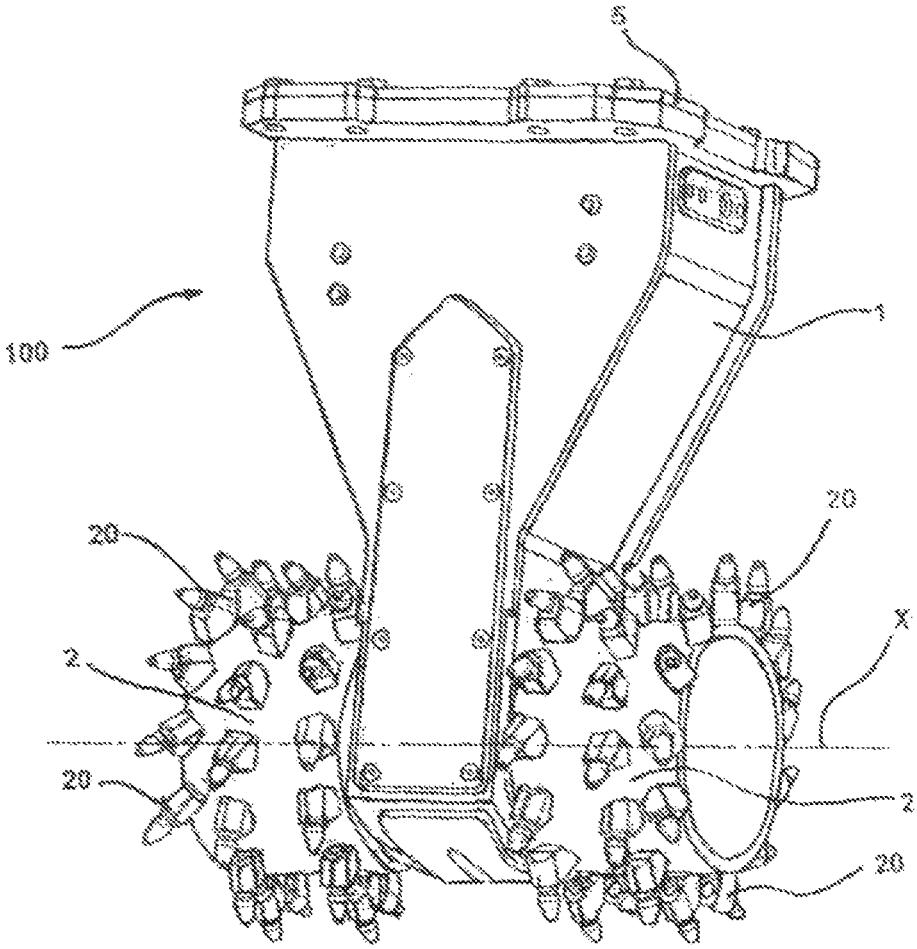
FIG. 1 is a perspective view of a hydraulic apparatus according to the present invention.

Referring initially to FIG. 1, a hydraulic apparatus for an excavator or more generally for a construction equipment, also referred to in the following as a supporting equipment, is denoted as a whole by reference numeral 100. As will be made clearer in the following, the hydraulic apparatus 100 is suitable for mounting on a movable arm of the excavator via a linking plate 5 or other equivalent attachment means.

Preferably, linking plate 5, or other coupling element, is configured such that the hydraulic apparatus 100 is rigidly connected to the movable arm.

The apparatus 100 comprises an outer shell 1, which defines a support structure on which a pair of drums 2 are rotatably supported.

Each drum 2 supports a plurality of teeth 20 which make it possible to grind the material as a result of the rotation of the drums 2.

Figure 2:
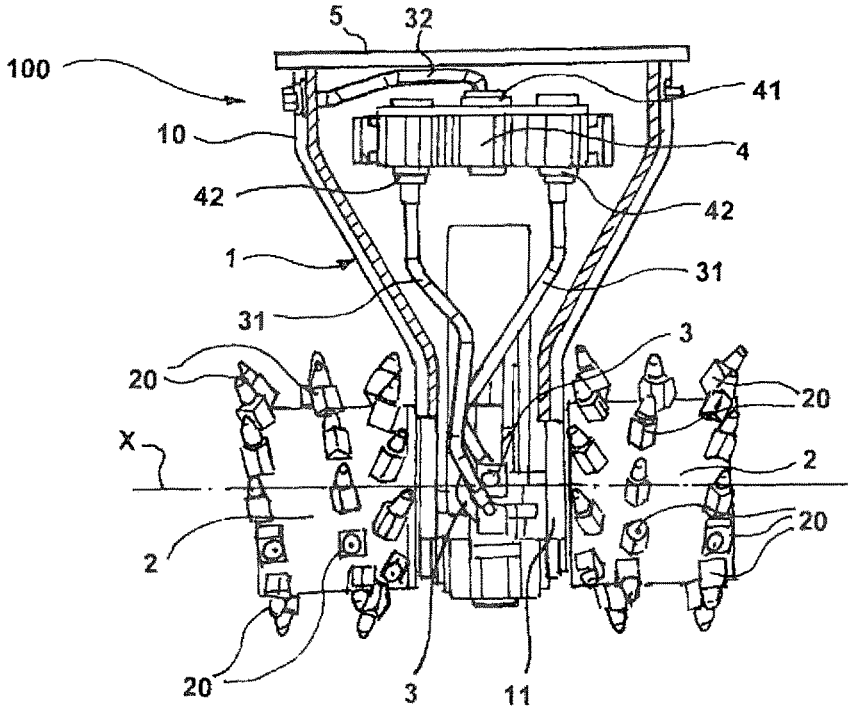
FIG. 2 is a partially sectional front view of the apparatus of FIG. 1.

Now also referring to FIG. 2, the apparatus according to the present invention further comprises a pair of hydraulic motors 3, each arranged for the movement of an associated drum 2. Preferably, the hydraulic motors 3 are mutually independent, meaning that each one is supplied with a particular oil supply, provided via a suitable supply duct 31, in such a way that the speed and torque provided by the rotation of one motor are independent of those of the other motor.

In a preferred embodiment, the support structure 1 comprises an enlarged portion 10, at which the linking plate 5 is located, and an end portion 11, opposite the plate 5 and linked to the enlarged portion 10 by a tapered segment.

Preferably, the motors 3 are positioned at the end portion 11, having an axis of rotation X perpendicular to a longitudinal extension direction of the support structure, substantially coincident with a removal direction of the excavator arm to which the plate 5 is fixed.

In a preferred embodiment, the drums 2 are directly connected to the respective motors 3 so as to also be rotatable about the axis of rotation X.

The apparatus according to the present invention further comprises a rotating flow divider device 4 which makes it possible to divide a supply of operative fluid into two parts, each to be directed to one of the two motors 3. Preferably, the flow divider 4 comprises at least two rotating elements 402, described in greater detail in the following with reference to FIG. 4, which are coaxial and mutually rotationally engaged.

The rotating flow divider device 4 is for example of the type marketed by Casappa under the trade name Polaris or described in U.S. Pat. No. 2,291,578.

Figure 3A:
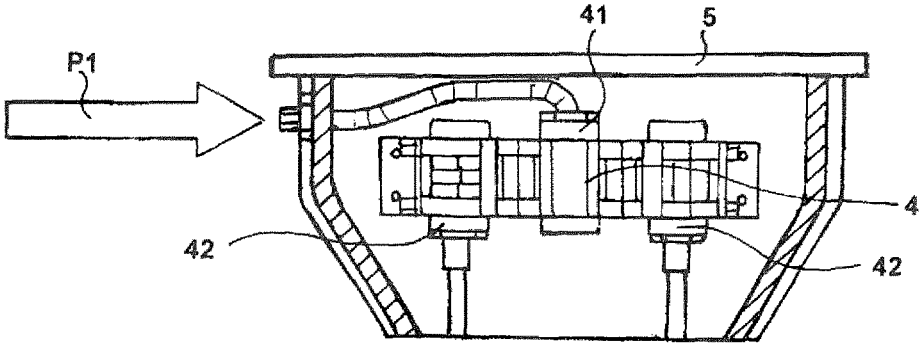
FIGS. 3A and 3B are a partial front view and a partial perspective view respectively, both partially sectional, of the apparatus according to the present invention, and schematically illustrate the operation thereof.
Figure 3B:
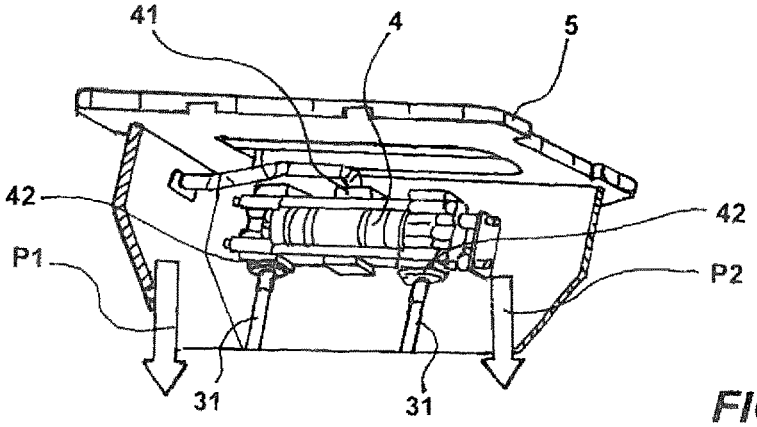
Figure 5:
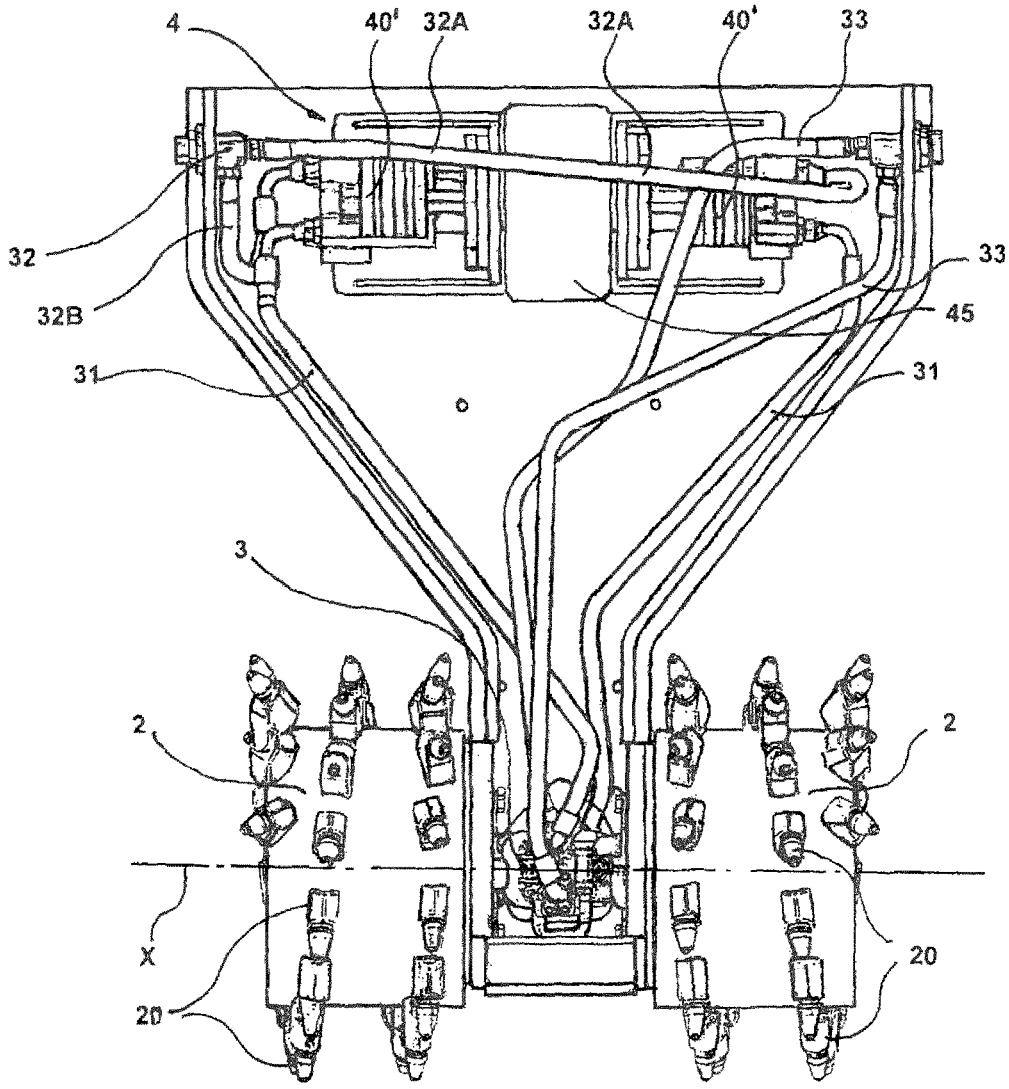
FIG. 5 is a partially sectional front view of a second embodiment of the apparatus according to the present invention.
Figure 8:
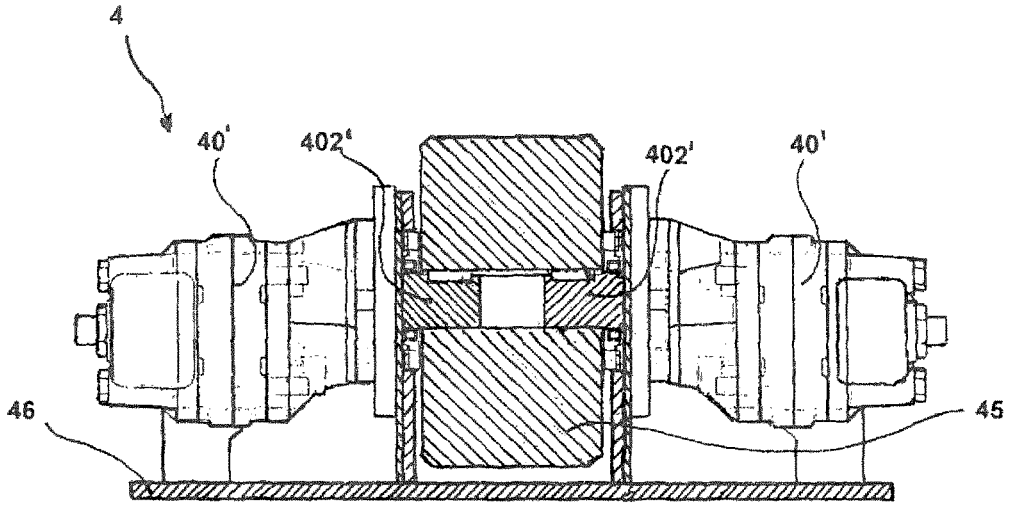
FIG. 8 is a partially sectional front view of the flow divider device of FIG. 7.
Figure 6A:
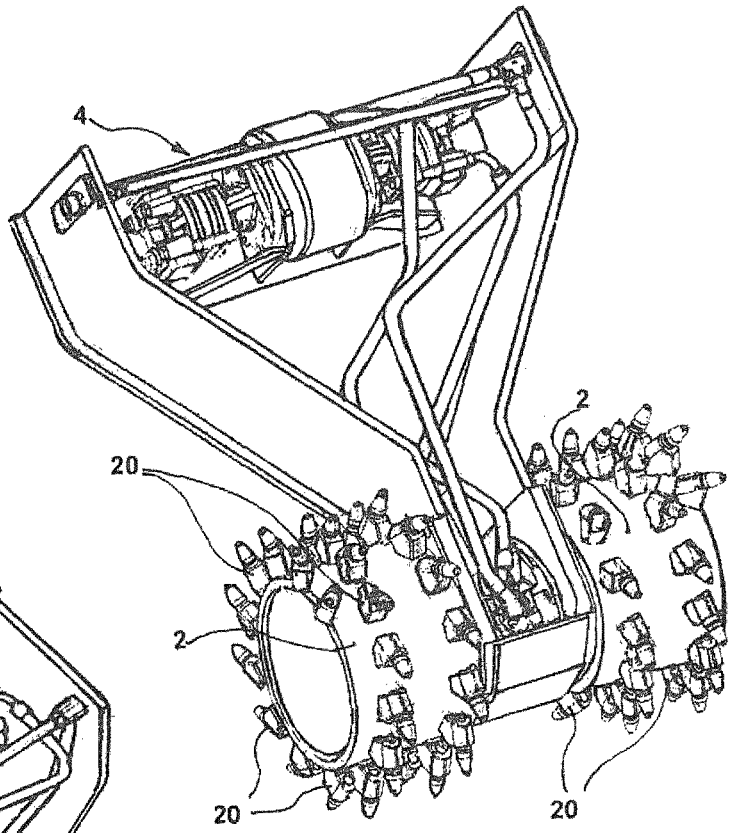
FIGS. 6A and 6B are two views, one from above and one from below, of the apparatus of FIG. 5.
Figure 6B:
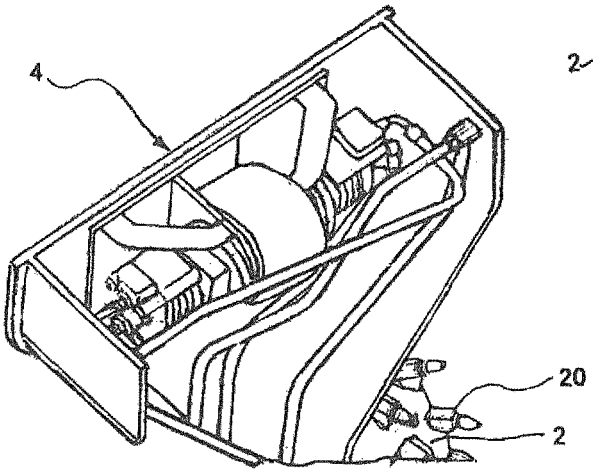
Figure 7:
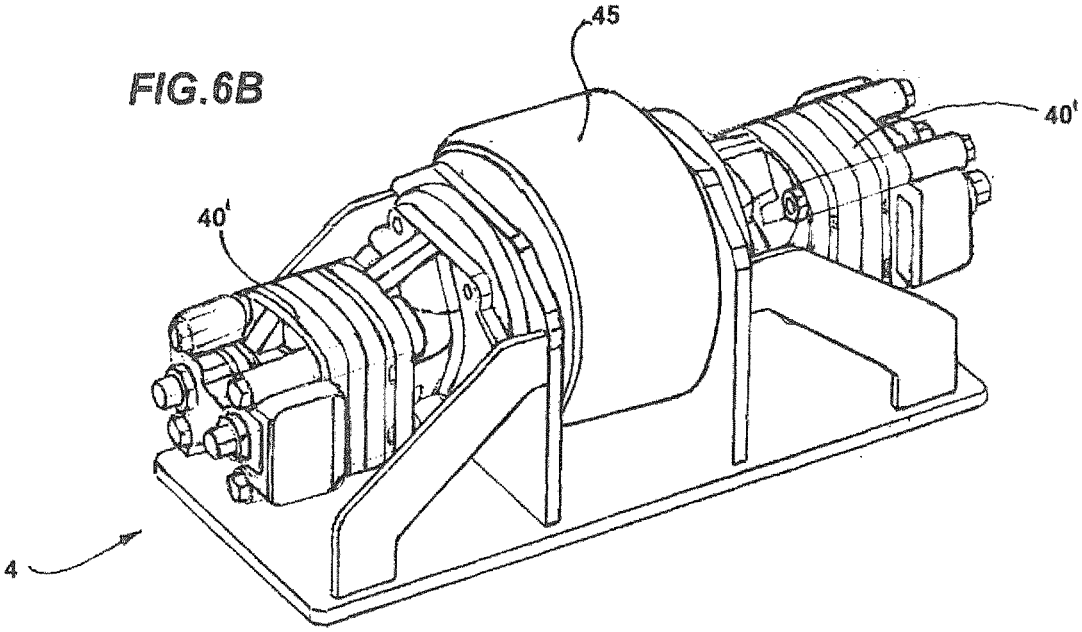
FIG. 7 is a perspective view of a flow divider device belonging to the apparatus of FIG. 5.
Figure 9A:
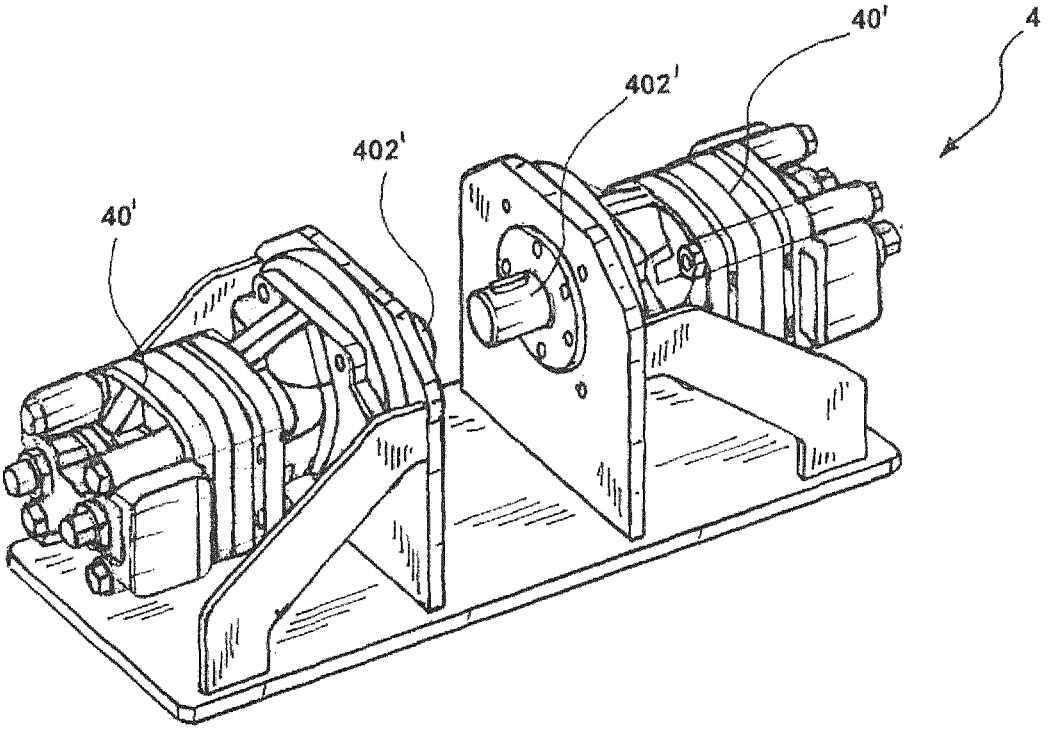
FIGS. 9A and 9B are two perspective views showing the flow divider device of FIG. 7 without a particular flywheel and showing this flywheel as a separate component.
Figure 9B:
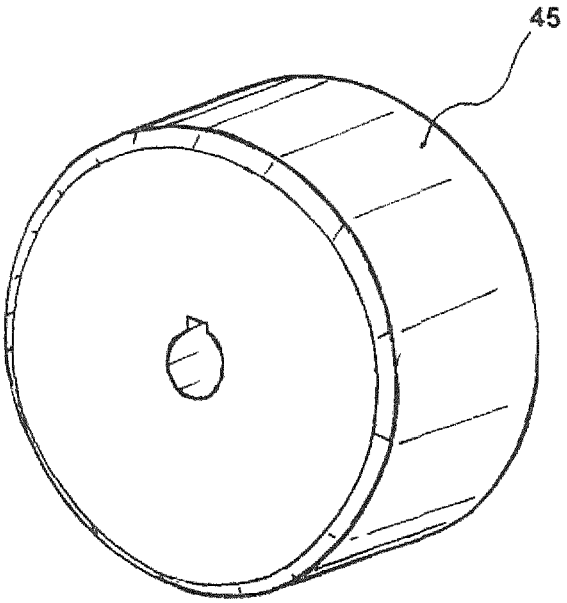

In greater detail, the flow divider device 4 comprises an inlet 41 for receiving the flow of operative fluid provided by the construction equipment and a pair of outlets 42, connected to the ducts 31 for providing the operative fluid, which is suitably subdivided, to each of the hydraulic motors 3, as is also shown in FIGS. 3A and 3B.

In a preferred embodiment, the device 4 is housed in the enlarged portion 10 of the support structure 1 and preferably receives a supply of fluid from the construction equipment by means of a duct 32 which can be linked to the hydraulic circuit thereof.

Figure 4:
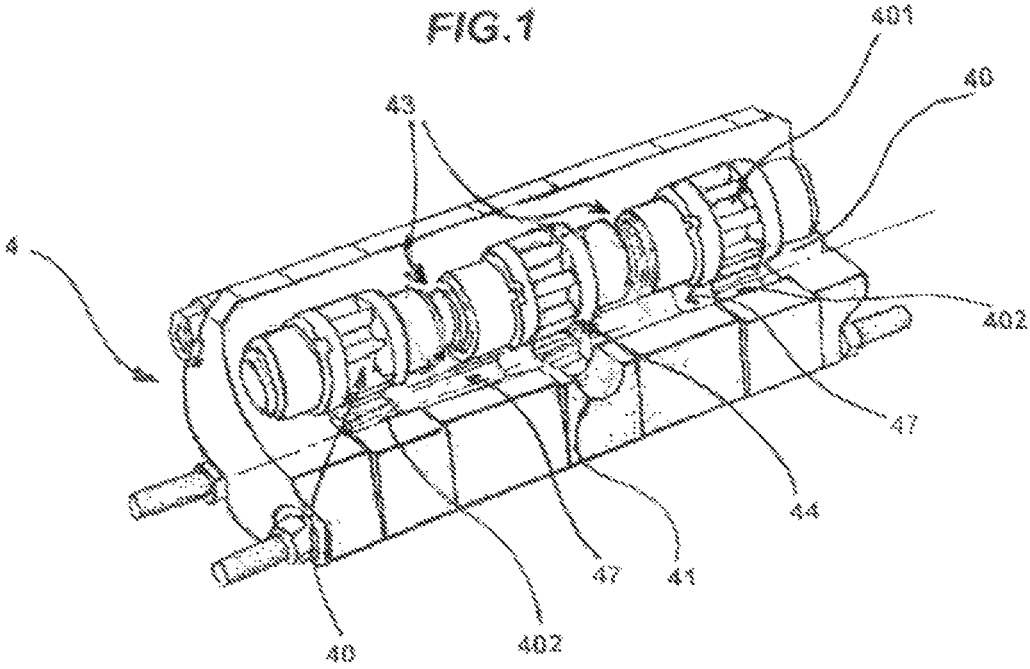
FIG. 4 is a perspective view of a flow divider device belonging to the apparatus of FIG. 1.

A first example of a flow divider device 4 is shown in FIG. 4 and is geared. More specifically, in the present embodiment, the rotating elements 402 are formed by gears.

In this type of flow divider device 4, there are at least two pairs 40 of gears 401, 402, each pair 40 being associated to a particular outlet 42 of the divider.

Preferably, the flow divider device 4 comprises a further pair of gears 44 associated to the inlet 41.

The operative liquid enters the divider at the inlet 41, setting the pair of gears 44 in rotation as a result of passing therebetween. Further, by way of a channelling system 47, the operative fluid reaches the outlets 42, passing between the gears 401 and 402 of the respective pairs of gears.

Thus, the gears used in the device 4 are actually formed so as to be able to work as gear pumps.

In the present embodiment, a gear 402 of one pair is meshed to the same shaft 43 as a corresponding gear 402 of the other pairs.

In this way, the gears rotate in a mutually engaged manner and at the same speed. For a better understanding of the operation of the divider device as applied to the present invention, it should be borne in mind that, as described above, the power requirement in each of the two motors may vary depending on the specific operating conditions in the two drums, and it should also be noted that in these types of pumps, the supply remains virtually constant for a fixed number of rotations, whilst the power varies approximately linearly with the pressure.

When a lower power is required in one of the two drums, there is thus a resulting lower pressure requirement at the outlet associated to the motor of this drum, and therefore a greater pressure will be available for the other gear and the associated outlet, thus making a greater power available to the other drum.

This therefore makes it possible to exploit the pressure provided by the construction equipment in an optimum manner.

In other words, the energy not used by the other drum is not dissipated as heat, but used in the other pair of gears by way of the linking shaft.

Now referring to FIGS. 5 to 9, a variant of the apparatus according to the present invention will now be described.

This variant comprises a flow divider device 4' which comprises a pair of auxiliary hydraulic motors 40' instead of the geared device described above.

Therefore, in this case, the rotating elements are formed by an outlet shaft 402' of each of the hydraulic motors 40'.

The hydraulic motors 40' are supplied with the same supply via lines 32A and 32B connected to the duct 32 which provides the operative fluid from the construction equipment.

Meanwhile, the outlet of the auxiliary hydraulic motors 40' is linked to the hydraulic motors 3.

The outlet shafts of the two motors are further interlinked by means of a connection element 45 which causes them to be rotationally engaged.

The system thus provided therefore acts as a flow divider in the same way as the device 4 described in relation to the present embodiment.

Preferably, the connection element 45 is formed from a flywheel which is locked to the two shafts 402' by means of keys.

This solution is found to be particularly advantageous in that, at the moment when the grinding drums 20 start to slow down and potentially become blocked as a result of the friction of the processed material, the inertial effect of the flywheel 45 comes into effect, preventing the hydraulic motors 40' from slowing down and actually increasing the grinding force, preventing the two drums from being blocked.

The invention thus solves the problem addressed whilst simultaneously leading to a plurality of advantages, including a lower frequency of blocking in the apparatus and a better use of the available power. If necessary, the flow divider device can even operate as a receiving divider having an instigator divider, solving the problem of continuous blockage which occurs when these apparatuses are used.

Further, comprising two independent motors, and thus not having a central linking spindle, provides a major advantage in that the stress transmitted by the apparatus to the arm of the excavator or of the supporting equipment is cushioned.

By comparison with solutions using a spindle for linking the rotors, the use of a flow and supply divider actually provides a damping effect in the transmission of the transverse stress to the arm, greatly reducing the problems in the arm of the equipment.

The invention claimed is:

1. A hydraulic rotating crusher apparatus for construction equipment, comprising a support structure connectable to a movable arm of the construction equipment, a pair or rotating drums including a plurality of teeth, a pair of hydraulic motors, each arranged for movement of a respective drum, and a rotating flow divider device, said rotating flow divider device including a pair of further hydraulic motors, said further hydraulic motors each including a coaxial shaft, the flow divider device further including a connection element interlinking the coaxial shaft of one further hydraulic motor with the coaxial shaft of the other further hydraulic motor so that the interlinked shafts are rotationally engaged, said hydraulic rotating crusher apparatus further comprising a common inlet for receiving a supply of operative fluid provided by the construction equipment, the common inlet being divided in two inlet connections, each inlet connection providing a supply of operative fluid to a respective one of the further hydraulic motors and a pair of outlets, each outlet connected to a respective one of the further hydraulic motors, which provide said supply of operative fluid, suitably divided by said further hydraulic motors, to said pair of hydraulic motors, said rotating flow divider device further including a flywheel connected to said connection element such that, when the one of the rotating drums starts to slow down as a result of friction of processed material, an initial effect of the flywheel prevents the further hydraulic motors from slowing down.

2. The hydraulic rotating crusher apparatus according to claim 1, wherein said rotating drums are rotatable independently each other about a single axis of rotation.

3. The hydraulic rotating crusher apparatus according to claim 1, wherein said support structure comprises an enlarged portion, within which said rotating flow divider device is housed and an end portion, within which said hydraulic motors are at least partially housed.

4. The hydraulic rotating crusher apparatus according to claim 3, comprising a coupling element for coupling to a free end of an arm of the construction equipment.

5. The hydraulic rotating crusher apparatus according to claim 4, wherein said coupling element is arranged opposite said end portion with respect to said enlarged portion.

6. The hydraulic rotating crusher apparatus according to claim 4, wherein said coupling element is configured such that the hydraulic apparatus is rigidly connected to the movable arm.

7. The hydraulic rotating crusher apparatus according to claim 1, wherein the rotating flow divider device further includes a casing, the inlet being defined by a central aperture formed in the casing.

8. The hydraulic rotating crusher apparatus according to claim 7, wherein the outlets are formed by respective holes formed in the casing on an opposite side with respect to the inlet.

9. The hydraulic rotating crusher apparatus according to claim 1, wherein the connection element includes rotating elements.

10. The hydraulic rotating crusher apparatus according to claim 1, wherein the connection element includes keys attached to the flywheel.

11. The hydraulic rotating crusher apparatus according to claim 1, wherein the further hydraulic motors are geared hydraulic motors.

* * * * *